US007484643B2

(12) United States Patent
Amaral et al.

(10) Patent No.: US 7,484,643 B2
(45) Date of Patent: Feb. 3, 2009

(54) LIQUID DISPENSING VALVE

(75) Inventors: Claiton Emilio Do Amaral, Joinville-SC (BR); Edson Isaltino Bento, Joinville-SC (BR)

(73) Assignee: Whirlpool, S.A., Sao Paulo- SP (BR)

( * ) Notice: Subject to any disclaimer, the term of this patent is extended or adjusted under 35 U.S.C. 154(b) by 22 days.

(21) Appl. No.: 10/599,849

(22) PCT Filed: Apr. 12, 2005

(86) PCT No.: PCT/BR2005/000053

§ 371 (c)(1),
(2), (4) Date: Jun. 13, 2007

(87) PCT Pub. No.: WO2005/000233

PCT Pub. Date: Oct. 27, 2005

(65) Prior Publication Data

US 2007/0262284 A1 Nov. 15, 2007

(30) Foreign Application Priority Data

Apr. 13, 2004 (BR) ..... 0401576

(51) Int. Cl.
*F16K 51/00* (2006.01)

(52) U.S. Cl. ..... 222/571; 251/321; 251/335.1; 251/339

(58) Field of Classification Search ..... 251/339, 251/335.1, 321, 322, 323; 222/571
See application file for complete search history.

(56) References Cited

U.S. PATENT DOCUMENTS

| | | | | |
|---|---|---|---|---|
| 3,940,030 | A * | 2/1976 | Kondo | 222/384 |
| 4,640,493 | A | 2/1987 | Dudzik | |
| 4,742,851 | A | 5/1988 | Lundblade | |
| 4,856,676 | A * | 8/1989 | Emody | 222/66 |
| 5,379,985 | A | 1/1995 | Waij et al. | |
| 5,551,605 | A * | 9/1996 | Bethlendy | 222/402.25 |
| 5,553,756 | A * | 9/1996 | Topper et al. | 222/496 |
| 5,683,015 | A | 11/1997 | Lee et al. | |
| 6,264,067 | B1 * | 7/2001 | Lasserre | 222/108 |
| 6,401,989 | B1 | 6/2002 | Grittmann et al. | |
| 2003/0089745 | A1 | 5/2003 | Friedman | |

* cited by examiner

*Primary Examiner*—John Bastianelli
(74) *Attorney, Agent, or Firm*—Darby & Darby P.C.

(57) ABSTRACT

A liquid dispensing valve having a body portion hermetically mounted to a free end of a discharge nozzle of a reservoir and defining a seat; a rod carrying a seal and being selectively displaced between a closing position in which the seal is seated on the seat, and a maximum opening position in which the seal is spaced from the seat; a cap portion hermetically affixed to the body portion downstream the seat and around the rod, and defining a discharge chamber; and an elongated spout having a discharge end turned downwards, said cap portion and elongated spout being configured and dimensioned so that, when the seat is closed, the mass of residual liquid contained in the discharge chamber forms, inside the latter, a vacuum which is sufficient to retain said mass of liquid inside the dispensing valve.

16 Claims, 2 Drawing Sheets

LIQUID DISPENSING VALVE

CROSS REFERENCE TO RELATED APPLICATIONS

This application is the U.S. National Phase Application under 35 U.S.C. §371 of International Patent Application No. PCT/BR2005/000053 filed Apr. 12, 2005, which claims priority to and the benefit of Brazilian Patent Application No. PI0401576-2, filed Apr. 13, 2004, each of which are hereby incorporated by reference in their entireties. The International Application published, in English, as WO 2005/100233 A1 on Oct. 27, 2005.

FIELD OF THE INVENTION

The present invention refers to a liquid dispensing valve to be operatively associated with a reservoir, such as reservoir for water or other liquids, provided inside a refrigerator and which allows the user to control the selective and gravitational release of the liquid into any recipient, such as a glass, a mug, et c.

PRIOR ART

There are well known from the art different constructions for a water reservoir to be mounted close to the internal panel of the front door of a refrigerating compartment of a refrigeration appliance defined by a refrigerator or a combined freezer-refrigerator appliance. A construction of this type is described in Brazilian Patent Application PI03 02286-2 filed on Jun. 1, 2003 by the same applicant.

In the type of assembly mentioned above, as well as in other applications in which the liquid is gravitationally dispensed from the reservoir, the latter is provided with a lower discharge nozzle to which is directly or indirectly coupled a liquid dispensing valve to be manually actuated by the user, who thus can control the release of liquid from the reservoir to a glass, mug or any other recipient to be provided with a certain amount of water and which is manually positioned under the discharge nozzle of the dispensing valve.

In the applications in which the reservoir is mounted inside the refrigerator, the dispensing valve is usually provided outside the cabinet of the refrigeration appliance in a recess generally provided outside the front door of the refrigerating compartment.

The liquid dispensing valves of the type considered herein usually presents a body adapted to a free end of the lower discharge nozzle of the reservoir, through which body is disposed an actuating rod carrying a seal to be seated against a seat provided in said valve body, the side of the valve body disposed downstream the seat being maintained in fluid communication with an elongated spout which is downwardly turned so as to direct the liquid that is flowing through the seat to the interior of a recipient, such as a glass, positioned under said elongated spout.

In these known constructions, after the user releases the rod, the seal is automatically seated against the seat, sealing it and preventing the liquid contained inside the reservoir and also inside its lower discharge nozzle from passing through the valve and reaching the inside of the collecting recipient. However, in these constructions the amount of residual water contained inside both the valve body and the elongated spout, which are disposed downstream the valve seat, flows down gravitationally, until said volume of residual liquid is completely depleted from the interior of both the body and the elongated spout. Considering that the velocity of the residual liquid flowing from the interior of the valve body through the elongated spout is lower than the velocity of the user to remove the recipient from below the dispensing valve, some dripping of the residual liquid will invariably occur through the elongated spout after the collecting recipient is removed from the filling position. This dripping is progressively accumulated in the support region of the collecting recipient, requiring the user to make additional periodical draining operations.

It should be emphasized herein that the actuation of the rod of these dispensing valves is generally made by means of a trigger operatively coupled to the valve rod and which is actuated by the liquid collecting recipient itself or by the user's hand holding said recipient during the liquid collecting process. Thus, the closing of the dispensing valve occurs when the collecting recipient or the respective user's hand is displaced away from the valve trigger, allowing the rod to automatically return to its resting position, closing the dispensing valve. Thus, the closing movement of the valve is invariably obtained by displacing the recipient out from the position in which it receives the liquid from the elongated spout of the dispensing valve, making the closing of the latter to occur with the beginning of the movement of removing the collecting recipient and making the residual liquid inside the dispensing valve body downstream the seat to continue its descending gravitational path toward a recipient which is no more positioned in a condition for collecting this residual liquid.

While it is possible to construct liquid dispensing valves presenting means which at least minimize the dripping of the residual liquid still contained inside the body of the dispensing valve after the closing of the latter, such constructions tend to considerably increase the cost of the valve and consequently of the end product to which it is coupled.

SUMMARY OF THE INVENTION

As a function of the operational disadvantage mentioned above, it is an object of the present invention to provide a liquid dispensing valve to be operatively associated with a reservoir to be mounted inside a refrigeration appliance, said dispensing valve presenting a simple and strong construction of low cost, which eliminates or at least considerably minimizes the dripping of the residual liquid still contained inside the valve body after the closing of the latter by the collecting recipient being removed from below the elongated spout of said dispensing valve.

It is a further object of the present invention to provide a liquid dispensing valve such as defined above, which minimizes the cooling of the valve body and consequently the condensation of the ambient humidity around the latter by the liquid maintained under refrigeration inside the reservoir.

It is another object of the present invention to provide a liquid dispensing valve such as defined above, which can be moved jointly with the reservoir to which it is coupled during the mounting and dismounting operations of the latter in relation to the structure of the refrigeration appliance to which it is coupled, facilitating the cleaning operations of said reservoir.

It is an additional object of the present invention to provide a liquid dispensing valve such as defined above, which can be easily mounted and dismounted in relation to the lower discharge nozzle of the reservoir.

These and other objects of the present invention are attained by the provision of a liquid dispensing valve, comprising: a body portion hermetically mounted to a free end of a discharge nozzle of a reservoir and which defines a seat; a rod mounted through the body portion, carrying a seal and being selectively displaced between a closing position and a maximum opening position; a spring means mounted to the body portion and forcing the rod to the closing position; a cap portion hermetically affixed to the body downstream the seat and around the rod and which defines, internally, a discharge chamber; and an elongated spout having a discharge end turned downwards, said cap and elongated spout portions being configured and dimensioned so that, when the seat is closed by the seal, the mass of residual liquid contained in the discharge chamber forms, gravitationally inside the latter, a vacuum which is sufficient to maintain said mass of liquid retained upstream the discharge end of the elongated spout.

With the construction defined above, after the closing of the seat of the dispensing valve, the amount of residual liquid contained inside both the discharge chamber and the elongated spout is gravitationally released only the sufficient to allow the vacuum which is formed inside the discharge chamber to be balanced with the weight of the mass of residual liquid, preventing the latter from gravitationally flowing outwardly from the dispensing valve and dripping on the support surface of the collecting recipient when the latter is no more in a collecting position for receiving the liquid which might flow from the dispensing valve.

BRIEF DESCRIPTION OF THE DRAWINGS

The invention will be described below, with reference to the enclosed drawings, given by way of example of an embodiment of the invention and in which.

DETAILED DESCRIPTION OF THE INVENTION

Figure 1:
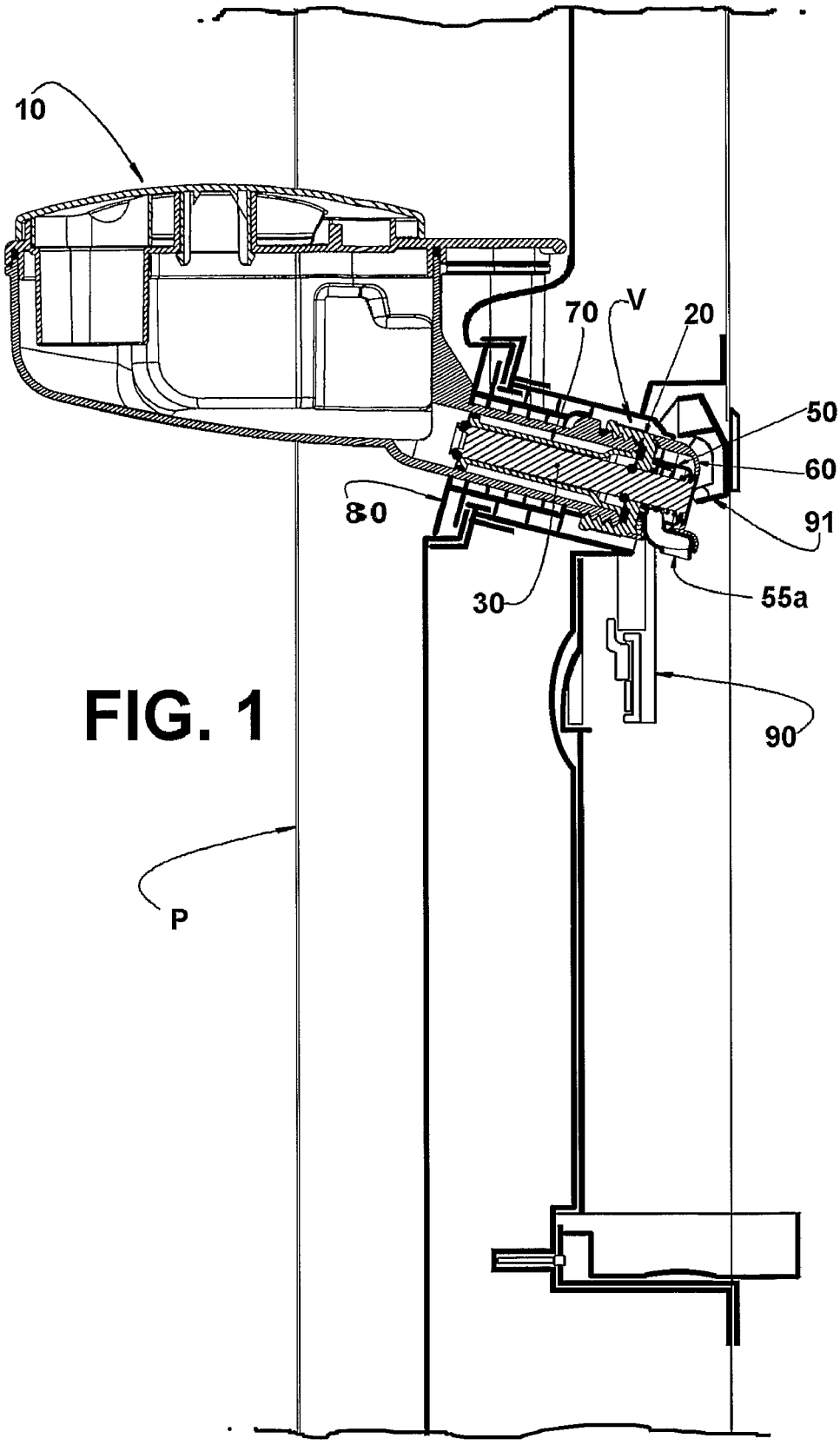
FIG. 1 is a cross-sectional view of a reservoir mounted to an internal panel of a partially illustrated refrigerator door, said reservoir being provided with a lower discharge nozzle, in which the present dispensing valve is mounted and illustrated in a closed condition.
Figure 2:
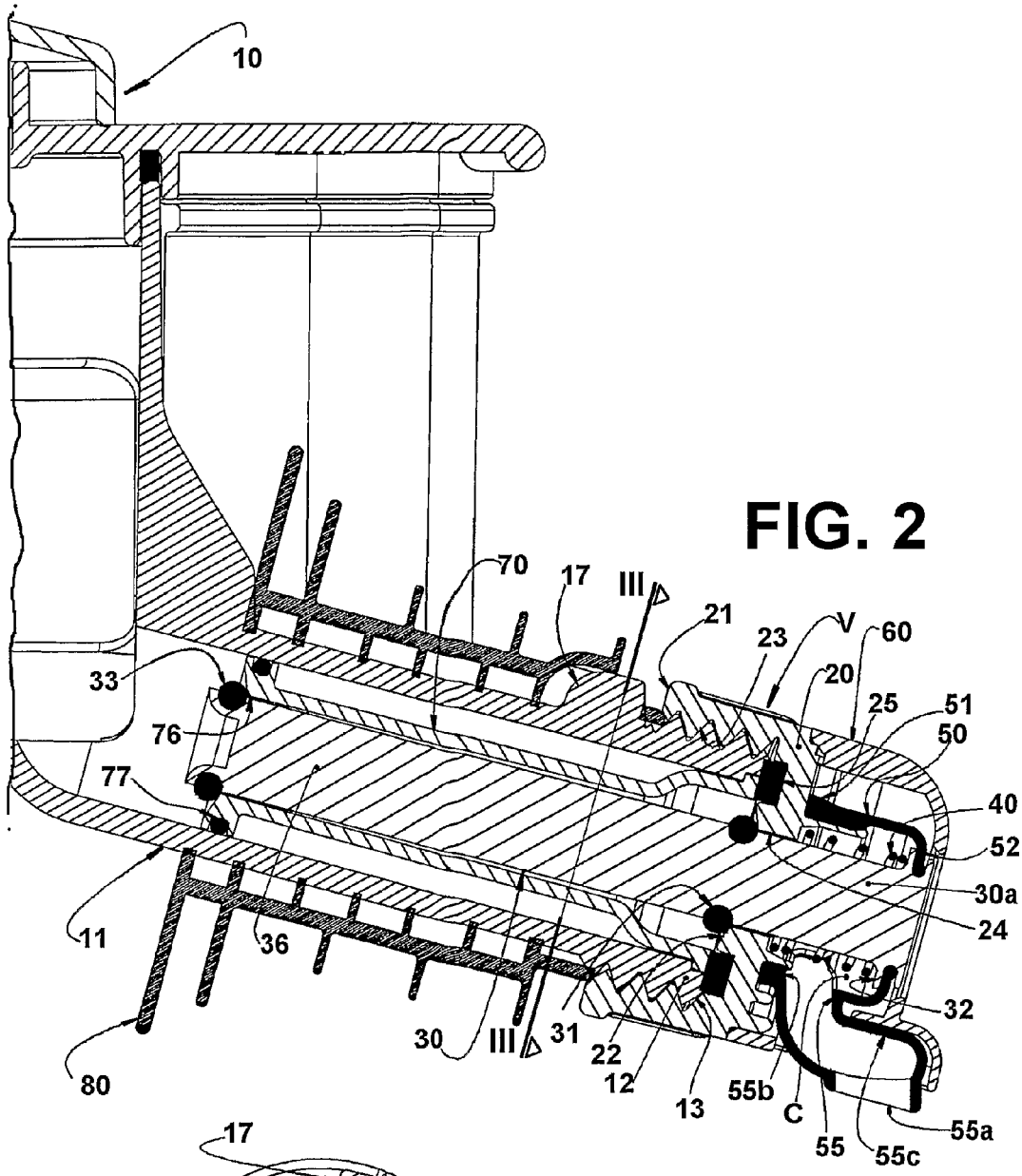
FIG. 2 is an enlarged view similar to that of FIG. 1, but illustrating only the discharge nozzle of the reservoir, carrying the dispensing valve.
Figure 3:
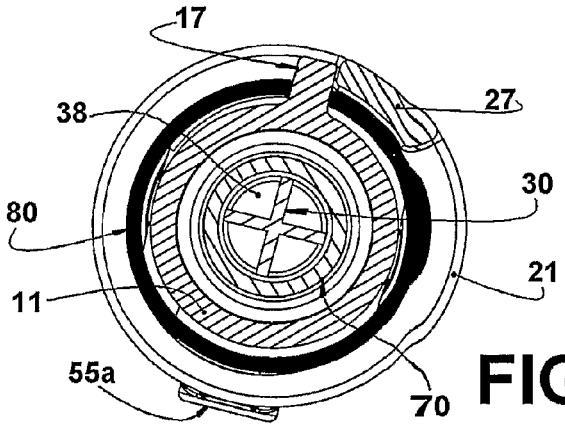
FIG. 3 is a cross-sectional view taken according to line II-II in FIG. 1.

As previously mentioned and in accordance with the enclosed drawings, the present liquid dispensing valve is applied to a reservoir 10 to be mounted inside a refrigeration appliance, more exactly inside a refrigerating compartment, so as to keep refrigerated the liquid stored in said reservoir. Although it is possible to configure the reservoir 10 in different manners and to mount it in different places inside the refrigerating compartment, it is usually preferred to apply it to the internal panel of the door "P" of said refrigerating compartment, and provided it with an elongated lower discharge nozzle 11 disposed through the thickness of the front door "P" of the refrigerating compartment so as to allow the user to help himself/herself of the liquid stored in the reservoir from the outside of the door "P" with no need of opening the latter.

In the illustrated embodiment, the reservoir 10 takes the form of the one described and claimed in Brazilian Patent Application PI0302286-2 of the same applicant, and therefore it is not necessary to describe it in details in the present patent application.

Considering the illustrated construction that is provided with the basic elements involved in the invention, the dispensing valve "V" is mounted to a free end 12 of the discharge nozzle 11 usually provided with an external thread 13, whose function will be described ahead.

According to the present invention, the liquid dispensing valve comprises a body portion 20 which can take the form of a plate disposed transversally to the axis of the discharge nozzle 11 and incorporating a tubular axial extension 21 provided with an internal thread 23 to be engaged to the external thread 13 provided in the free end 12 of the discharge nozzle 11.

The body portion 20 is medianly provided with a seat 22 defined in the internal end of a central axial hole 24 provided through the body portion 20, communicating the sides of the body portion 20 which are situated upstream and downstream said seat 22.

In the illustrated construction, the body portion 20 carries, in an internal annular face surrounding the seat 22, an annular gasket 25 made of elastomeric material and to be pressed against the free end 12 of the discharge nozzle 11, upon mounting the dispensing valve "V" to said discharge nozzle 11.

The liquid dispensing valve further comprises a rod 30 mounted through the body portion 20, carrying a seal 31 and being selectively displaced, usually in an axial direction, between a closing position illustrated in FIG. 1 and in which the seal 31 is seated on the seat 22, blocking the release of liquid from the reservoir 10, and a maximum opening position (not illustrated) in which the seal 31 is spaced from the seat 22, releasing the liquid from the reservoir 10.

While the illustrated construction comprises a rod 30 to be axially displaced by actuation of the user, it should be understood that other actuating arrangements of the valve through rods with a rotary or angular displacement could be used, provided they can move the respective seal between the closing and opening positions of the dispensing valve "V".

In these constructions, the rod 30 is desired to be constantly resiliently forced to the closing position to guarantee the closing of the dispensing valve "V" when the user ceases to operate it. Thus, the present dispensing valve "V" further comprises a spring means 40 mounted to the body portion 20 and forcing the rod 30 to the closing position illustrated in FIG. 1. In the illustrated embodiment, the spring means 401 is defined by a helical spring mounted around the end portion 30*a* of the rod 30 external to the body portion 20, said helical spring having an end seated against the body portion 20 and an opposite end seated against a peripheral salience 32 incorporated to said end portion 30*a* of the rod 30.

The dispensing valve "V" further comprises a cap portion 50 hermetically affixed to the body portion 20 downstream the seat 22 and around the rod 30, and internally defining a discharge chamber "C". According to the illustrated embodiment, the cap portion 50 presents a tubular shape having an end 51 hermetically affixed to the body portion 20 and an opposite end 52 hermetically affixed to an end portion 30*a* of the rod 30 external to the body portion 20, said cap portion 50 thus defining a discharge chamber "C" of annular tubular shape around the end portion 30*a* of the rod 30 external to the body portion 20. It should be noted that the end 51 and the opposite end 52 of the cap portion 50 are airtightedly coupled to the respective parts of body portion 20 and end portion 30*a* of the rod 30, not allowing the atmospheric air to enter into the discharge chamber "C" through the junctions of its ends 51, 52 with the adjacent component parts of the dispensing valve "V".

Considering the rod 30 as being axially displaced between its operational positions, the opposite end 52 of the cap portion 50 is defined by an annular wall which is internally peripherally coupled to the adjacent end portion 30*a* of the rod 30, whereby during the axial displacement of the latter the cap portion 50 is forced to be resiliently deformed, accompanying the movement of the rod 30. Thus, in the illustrated embodiment, the cap portion 50 is formed in elastomeric material, further incorporating, in a single piece, an elongated spout 55 having a discharge end 55*a* turned downwards and an inlet end 55*b* opened to the inside of the discharge chamber "C" by means of a respective opening provided in the lateral wall of the cap portion of tubular shape.

As illustrated, the elongated spout 55 is configured to have its inlet end 55*b* radially opened to the inside of the discharge chamber "C" and united to the discharge end 55*a* by means of an intermediary portion 55*c* which is approximately orthogonal to the axis of the inlet end 55*b* and discharge end 55*a*.

With the construction above, the discharge chamber "C" is disposed in such a way as to receive, therewithin, the liquid which is flowing through the seat 22 when the dispensing valve "V" is opened, allowing the liquid to flow down gravitationally through the elongated spout 55 to be then collected in the interior of any recipient (not illustrated) positioned under said elongated spout 55.

In order to allow the dispensing valve "V" to operate in the manner proposed by the invention, the cap portion 50 and the elongated spout 55 are configured and dimensioned to allow, when the seat 22 is closed by the seal 31, the mass of residual liquid contained in the discharge chamber "C" to form, gravitationally inside the latter, a vacuum which is sufficient to maintain said mass of liquid retained upstream the discharge end 55*a* of the elongated spout 55, preventing the mass of residual liquid from dripping outwardly from the elongated spout 55, after the collecting recipient has been removed from the filling position under said elongated spout 55.

The dispensing valve "V" can be further provided with a casing 60, generally in injected plastic material, which is mounted to the body portion 20 so as to laterally involve both the cap portion 50 and the elongated spout 55, protecting the elastomeric material construction of the assembly formed by the cap portion 50 and elongated spout 55.

As illustrated, the seal 31 can take the form of a resilient ring mounted in a circumferential channel of the rod 30 disposed upstream the seat 22.

In order to block the cool liquid in a region away from the body portion 20, the rod 30 may present an axial extension 36 inside the discharge nozzle 11 of the reservoir 10 and carrying, in its free end portion, an additional seal 33, said discharge nozzle 11 carrying, internally, an additional seat 76 axially spaced from the seat 22 and against which the additional seal 33 is seated when the rod 30 is displaced to its closing position. The additional seat 76 can be defined at one end of a tubular sleeve 70, having the opposite end widened and hermetically affixed to the free end 12 of the discharge nozzle 11. In the illustrated construction, the widened end of the tubular sleeve 70 is seated on an internal peripheral depression of the free end 12 of the discharge nozzle 11, being retained therein by actuation of the gasket 25 pressed by the body portion 20.

It should be further noted that the tubular sleeve 70 presents the end which is adjacent to the additional seat 76 hermetically coupled to the internal wall of the discharge nozzle 11 of the reservoir 10 by means of a elastic seal ring 77, which prevents the cool liquid contained in the reservoir 10 from penetrating in the space defined between the tubular sleeve 70 and the internal wall of the discharge nozzle 11. With the illustrated construction, the additional seat 76 provides the blocking of the cool liquid in a region close to the inside of the refrigerating compartment and distant from the free end 12 of the discharge nozzle 11, preventing the low temperatures of the stored liquid from cooling the region of the body portion 20 exposed to the atmospheric air and which, on being cooled, could generate condensation in this region of the dispensing valve "V".

In order to allow the body portion 20, upon being threaded to the free end 12 of the discharge nozzle 11, to reach a fixation position in which the elongated spout 55 remains with its discharge end 55*a* turned downwards, the body portion 20 incorporates, in its tubular axial extension 21, a tongue 27 to be seated against a stop means 17 which is radially and externally incorporated to the discharge nozzle 11 when the dispensing valve "V" is fully covered in the free end of the discharge nozzle 11, maintaining the elongated spout turned downwards.

In the type of assembly illustrated herein, the discharge nozzle 11 can be involved by a tubular gasket 80 in elastomeric material, which is configured to allow the reservoir 10 to be easily mounted and dismounted jointly with the discharge nozzle 11 and the dispensing valve "V" in relation to the front door of the refrigerating compartment, and at the same time guarantee an adequate thermal insulation between the structure of the discharge nozzle 11 and the adjacent internal walls of the front door of the refrigerating compartment.

In order to allow the liquid to flow along the annular spaces defined between the rod 30 and the body portion 20 and the tubular sleeve 70, the rod 30 is constructed so as to present longitudinal grooves 38 along at least part of the extension thereof and along which grooves 38 will flow the liquid to be dispensed when the rod 30 is displaced to an opening position of said respective seat 22 and additional seat 76.

The displacement of the rod 30 from the closing position to the opening position can be made by means of a lower trigger 90, superiorly coupled to the structure of the door "P" and which is incorporated to a lever 91 having a free end actuating against the end of the rod 30 which is accessible through a respective front opening in the casing 60.

While only one form of carrying out the invention has been illustrated herein, it should be understood that changes in the form and arrangement of the component parts could be made without departing from the constructive concept set forth in the appended claims.

The invention claimed is:

1. A liquid dispensing valve, comprising:

a body portion hermetically mounted to a free end of a discharge nozzle of a reservoir and defining a seat; a rod mounted through the body portion, carrying a seal and being selectively displaced between a closing position in which the seal is seated on the seat, blocking the discharge of liquid from the reservoir, and a maximum opening position, in which the seal is spaced from the seat, allowing the discharge of the liquid; a spring means mounted to the body portion and forcing the rod to the closing position; a cap portion hermetically affixed to the body portion downstream the seat and around the rod, and internally defining a discharge chamber; and an elongated spout having a discharge end turned downwards, said cap portion and elongated spout being configured and dimensioned so that when the seat is closed by the seal, the mass of residual liquid contained in the discharge chamber forms, gravitationally inside the latter, a vacuum which is sufficient to maintain said mass of liquid retained upstream the discharge end of the elongated spout.

2. The valve as set forth in claim 1, wherein the cap portion presents a tubular shape, having an end hermetically affixed to the body portion and an opposite end hermetically affixed to an end portion of the rod external to the body portion.

3. The valve as set forth in claim 2, wherein the cap portion defines a discharge chamber in annular tubular shape around the end portion of the rod external to the body portion.

4. The valve as set forth in claim 3, wherein the opposite end of the cap portion is defined by an annular wall internally and peripherally coupled to the adjacent end portion of the rod.

5. The valve as set forth in claim 1,wherein the cap portion is formed in elastomeric material.

6. The valve as set forth in claim 5, wherein the cap portion and the elongated spout are formed in a single piece.

7. The valve as set forth in claim 1, wherein the body portion further comprises, externally, a casing laterally involving the cap portion and the elongated spout.

8. The valve as set forth in claim 1, wherein the elongated spout has an inlet end radially opened to the inside of the discharge chamber and united to the discharge end by means of an intermediary portion which is approximately orthogonal to the axis of both the inlet end and the discharge end.

9. The valve as set forth in claim 1, wherein the rod is axially displaced between the closing and opening positions of the dispensing valve.

10. The valve as set forth in claim 9, wherein the seal takes the form of an elastic ring mounted in a circumferential channel of the rod disposed upstream the seat.

11. The valve as set forth in claim 10, wherein the rod presents an axial extension internal to the discharge nozzle of the reservoir and comprising, at its free end portion, an additional seal, said discharge nozzle comprising, internally, an additional seat axially spaced from the seat and against which the additional seal is seated when the rod is displaced to its closing position.

12. The valve as set forth in claim 11, wherein the additional seat is defined in an end of a tubular sleeve, having the opposite end widened and hermetically affixed to the free end of the discharge nozzle.

13. The valve as set forth in claim 12, wherein the body portion of the dispensing valve presents a tubular axial extension provided with an internal thread to be engaged with an external thread provided in the free end of the discharge nozzle.

14. The valve as set forth in claim 13, wherein the body portion comprises, in an internal annular face, an annular gasket to be simultaneously pressed against the opposite end of the tubular sleeve and against the free end of the discharge nozzle when the dispensing valve is mounted to the latter.

15. The valve as set forth in claim 1, wherein the body portion incorporates, in its tubular axial extension, a tongue to be seated against a stop means which is radially and externally incorporated to the discharge nozzle when the dispensing valve is completely engaged to the free end of the discharge nozzle, maintaining the elongated spout turned downwards.

16. The valve as set forth in claim 9, wherein the spring means is defined by a helical spring mounted around the end portion of the rod, external to the body portion, having an end seated against the latter and an opposite end seated against a peripheral salience incorporated to said end portion of the rod.

* * * * *